US012757943B2

(12) United States Patent
Charlsen

(10) Patent No.: US 12,757,943 B2
(45) Date of Patent: Oct. 13, 2026

(54) VAPORIZER SYSTEM

(71) Applicant: Glenn Charlsen, Rocklin, CA (US)

(72) Inventor: Glenn Charlsen, Rocklin, CA (US)

( * ) Notice: Subject to any disclaimer, the term of this patent is extended or adjusted under 35 U.S.C. 154(b) by 450 days.

(21) Appl. No.: 18/504,125

(22) Filed: Nov. 7, 2023

(65) Prior Publication Data

US 2024/0156172 A1 May 16, 2024

Related U.S. Application Data

(60) Provisional application No. 63/424,132, filed on Nov. 10, 2022.

(51) Int. Cl.

| | |
|---|---|
| ***A24F 40/51*** | (2020.01) |
| ***A24F 40/10*** | (2020.01) |
| ***A24F 40/42*** | (2020.01) |
| ***A24F 40/48*** | (2020.01) |
| ***A24F 40/60*** | (2020.01) |
| ***A24F 40/65*** | (2020.01) |

(52) U.S. Cl.

CPC ..... *A24F 40/51* (2020.01); *A24F 40/10* (2020.01); *A24F 40/42* (2020.01); *A24F 40/48* (2020.01); *A24F 40/60* (2020.01); *A24F 40/65* (2020.01)

(58) Field of Classification Search

CPC ..... A24F 40/42; A24F 40/48

See application file for complete search history.

(56) References Cited

U.S. PATENT DOCUMENTS

| | | | | |
|---|---|---|---|---|
| 9,675,117 | B2 | 6/2017 | Li et al. | |
| 10,065,005 | B2 | 9/2018 | Wilder et al. | |
| 10,765,821 | B2 | 9/2020 | Raichman | |
| 10,820,634 | B2 | 11/2020 | Crowe et al. | |
| 11,484,898 | B2 | 11/2022 | Woodbine et al. | |
| RE49,335 | E | 12/2022 | Zhou | |
| 2016/0211693 | A1 | 7/2016 | Stevens et al. | |
| 2017/0020198 | A1 | 1/2017 | Naqwi et al. | |
| 2019/0307175 | A1 | 10/2019 | Rostami et al. | |
| 2020/0060338 | A1* | 2/2020 | Danek | A61M 11/005 |
| 2021/0360978 | A1* | 11/2021 | Grandjean | A24F 40/20 |

(Continued)

FOREIGN PATENT DOCUMENTS

| | | | | |
|---|---|---|---|---|
| CA | 3131009 | | 8/2020 | |
| WO | WO-2020250111 | A1 * | 12/2020 | A24F 40/40 |

(Continued)

*Primary Examiner* — Katelyn W Smith

*Assistant Examiner* — Thomas Frank Schneider

(57) ABSTRACT

Embodiments of the present invention may include a vaporizer system. The vaporizer system may have a housing. A dispenser receptacle may be configured within the housing. A dispenser may be removably configured within the dispenser receptacle. An advancement mechanism may be configured distal to the dispenser receptacle. The advancement mechanism may advance vaporizable substance from the dispenser into an atomizer. The atomizer may apply heat to the vaporizable substance, thereby vaporizing the vaporizable substance. Vapor created from the vaporizable substance may exit the housing via an orifice and be inhaled by a user. The atomizer may be permanently configured within the housing. At least one sensor of the vaporizer system may obtain sensor data. A processing device of the vaporizer system may analyze the sensor data to determine at least one parameter.

20 Claims, 7 Drawing Sheets

(56) References Cited

U.S. PATENT DOCUMENTS

| | | | | |
|---|---|---|---|---|
| 2021/0360981 | A1* | 11/2021 | Memari | A24F 40/95 |
| 2022/0132924 | A1 | 5/2022 | Kahl et al. | |
| 2023/0000152 | A1* | 1/2023 | Tezuka | A24F 40/30 |
| 2023/0042987 | A1* | 2/2023 | O'Hare | A24F 40/50 |

FOREIGN PATENT DOCUMENTS

| | | | | |
|---|---|---|---|---|
| WO | WO-2021099467 | A1 * | 5/2021 | G05B 11/28 |
| WO | WO-2021260897 | A1 * | 12/2021 | A24F 40/57 |
| WO | 2023083646 | | 5/2023 | |

* cited by examiner

VAPORIZER SYSTEM

This application claims priority of U.S. provisional patent application 63/424,132, filed on Nov. 10, 2022, which is hereby incorporated by reference.

BACKGROUND OF THE INVENTION

The field of inhalation systems is technologically important to several industries, business organizations, and/or individuals.

Common inhalation systems include vaporizer devices and combustible devices that produce a vapor, mist, or smoke, which is able to be respired by a person. These inhalation systems use material such as tobacco or other plants, as fuel to be consumed to form the vapor or smoke. For example, cigarettes have a quantity of tobacco rolled within a paper; a user ignites one end of the rolled paper and inhales through the opposite end. A filter can optionally be placed between the tobacco and the exit from the rolled paper. When paper and tobacco are held to a flame they combust and produce smoke. The smoke is pulled through the remaining tobacco, through the filter, and into the mouth of the user.

With the belief that inhaled smoke has negative consequences, alternative methods and devices to produce an inhalable form of tobacco or other materials vaporizer devices have been developed to use non-combustible forms of the material that can be turned from a liquid to vapor for inhalation.

While developments have been made in the area of common vaporizer systems, room exists for further improvement. It is a known desire in the art that the delivery of an optimal quantity of vapor via the burning of an optimal quantity of vaporizable material at a particular rate enabled by a particular quantity of electrical current in a way that is intuitive to use and which is customizable to user preferences is to be enabled by this present invention and other vaporizer devices. It is a further known problem in the art that batteries near full charge may deliver an undesirably powerful current, and that batteries near depletion may deliver insufficient current. It is a further known problem in the art that the control of the electronic components of vaporizer may be unintuitive to control or may require more controls on the body of a vaporizer than is practical or ergonomic. Therefore, there is a need for improved vaporizers that may overcome one or more of the above-mentioned problems and/or limitations.

SUMMARY OF THE INVENTION

Embodiments of the present invention may comprise a vaporizer system. The vaporizer system may further comprise a housing. A dispenser receptacle may be configured within the housing. The dispenser receptacle may comprise a hollow space within the housing, into which components such as a dispenser may be placed. A dispenser may be removably fixed within the dispenser receptacle.

A vaporizable substance may be removably placed within the dispenser, as when a user intends to consume the vaporizable substance. The vaporizable substance may be a cannabis extract; other vaporizable substances may comprise tobacco, or other dry herbs, botanicals, or substances as are known in the art. This is to say that the vaporizable substance may contain one or more chemicals taken from a cannabis plant, which is any plant of the genus "*Cannabis*". The vaporizable substance may alternatively be a tobacco extract. This is to say that the vaporizable substance may contain one or more chemicals taken from a tobacco plant, which is any plant of the genus "*Nicotiana*". The vaporizable substance may further comprise a liquid, said liquid comprising combinations of the aforesaid vaporizable substances in varying quantities, propylene glycol, water, vegetable glycerin, flavorings, colorings, or other additives known in the art. Furthermore, the vaporizable substance may comprise an oil; in the art, such an oil may have a viscosity anywhere within the range of 5,000 to 1,000,000 centipoise, inclusive of said values.

An orifice may be configured at the most proximal end of the housing, relative to the user's position relative to the present invention in the preferred embodiment. The orifice may be an opening that allows vapor to travel out of the housing to be inhaled by a user. The orifice may be configured proximal to the dispenser receptacle. An advancement mechanism may be configured distal to the dispenser receptacle, and thereby configured distal to the dispenser when the dispenser is removably configured within the dispenser receptacle.

An atomizer may be configured within the housing. The atomizer may be configured distal to the orifice and proximal to the dispenser receptacle. The advancement mechanism may advance at least some of the vaporizable substance from the dispenser into the atomizer. The atomizer may apply heat to the at least some of the vaporizable substance, whereby the at least some of the vaporizable substance may be vaporized, whereby the vapor created from the at least some of the vaporizable substance may exit the housing via the orifice. The vaporizable substance that is vaporized may be inhaled by a user. The heat applied by the atomizer to the at least some of the vaporizable substance may be sufficient to vaporize the at least some of the vaporizable substance.

The atomizer may be a heating element, crucible, burner, or another device that causes the vaporizable substance to transform from a fluid state into a gaseous state. The atomizer may apply heat to the at least some of the vaporizable substance using a coil that is heated by electricity. The atomizer may be removably configured within the housing. Alternatively, the atomizer may be fixed within the housing.

The advancement mechanism may include a screw, the screw further comprising screw threads that engage with corresponding housing threads disposed within the housing. The screw may be rotated by means of a motor, or manually by the operation of a user. By being rotated, the screw may advance proximally through the housing, thereby advancing at least some of the vaporizable substance from the dispenser into the atomizer.

In other embodiments, the advancement mechanism may include a piston. The piston may be advanced proximally through the housing by a linear actuator or manually by the operation of a user. By advancing proximally through the housing, the piston may advance at least some of the vaporizable substance from the dispenser into the atomizer.

In other embodiments, the advancement mechanism may include a pump. The pump may use pressure to advance at least some of the vaporizable substance from the dispenser into the atomizer. The pump may pump a gas or fluid distal to a piston, thereby creating positive pressure distal to the piston, thereby advancing the piston proximally through the housing, whereby the piston advances at least some of the vaporizable substance from the dispenser into the atomizer. The pump may alternatively remove gas that is proximal to the dispenser, thereby creating negative pressure proximal to the dispenser, whereby at least some of the vaporizable substance is advanced from the dispenser into the atomizer.

A battery may be removably configured within the housing. The battery may supply electrical power to the atomizer, advancement device, and/or other electrical components of the vaporizer system.

In certain embodiments, the vaporizer system may further comprise at least one sensor. The at least one sensor may obtain sensor data. The sensor data may be measurements of an amount of vaporizable substance configured within the dispenser. The sensor data may be measurements of a volume of vapor created by the vaporizer system. The sensor data may be measurements of a pressure of vapor created by the vaporizer system. The vapor having the pressure may be configured within the housing of the vaporizer system. The sensor data may be durations of time for which the battery will continue to provide power. The sensor data may be measurements of heat applied by the atomizer to the vaporizable substance. The sensor data may be measurements of the voltage and/or amperage of an electrical current produced by the battery. The sensor data may be measurements of electrical power supplied by the battery to the various components of the vaporizer system, including but not limited to the atomizer.

The vaporizer system may further comprise a processing device. The processing device may be communicatively coupled with a communication device and a storage device. The storage device may store the sensor data obtained by the at least one sensor. The processing device may analyze the sensor data obtained by the at least one sensor. The communication device may transmit the sensor data obtained by the at least one sensor to a user device. The user device may be a computing device comprising at least one receiving means, at least one output means, and software configured to receive data from the vaporizer system in embodiments comprising this processing device, as understood in the art.

The processing device may detect if any of the sensor data exceeds a sensor data threshold. If any of the sensor data is detected by the processing device to exceed a sensor data threshold, the communication device may transmit data to the user device which is processed by means of the software to cause the at least one output means to output an alarm or other alert as directed by said software.

The vaporizer system may have a MOSFET chip. The MOSFET chip may be configured to control the amount of power provided by the battery to the various electrical components of the vaporizer system, including the atomizer. The MOSFET chip may control the amount of power provided by the battery to each electrical component of the vaporizer system independently, whereby each electrical component may receive a different amount of power. The MOSFET chip may use pulse width modulation to control the amount of power provided by the battery. The MOSFET chip may prevent a short circuit from occurring within the vaporizer system. The vaporizer system may be configured to output a stable power or a maximum/minimum imit. This allows for safety cut-outs in case of short circuits and low battery voltage.

The MOSFET chip may be further configured to allow a user to adjust the amount of power provided by the battery. Any embodiment comprising this configuration will itself further comprise an input means; the input means may be an input device integrated in the vaporizer system, an interactive software application configured to interface with the vaporizer system via the user device as described herein, or other means as may be apparent in the art. This may allow the user to choose an optimal amount of power to vaporize the vaporizable substance per the user's requirements. The user may adjust the amount of power provided by the battery to prevent the atomizer from applying too much heat to the vaporizable substance whereby the vaporizable substance is vaporized and not burned.

In further embodiments, the vaporizer system may be upgraded to a mod. Further, the vaporizer system may be available in a semi-regulated version with few safety features such as an electronic switch operation—i.e., 5 clicks on and off. Further, the disclosed system may show battery life and also be cut off in the case of a short circuit.

In further embodiments, the vaporizer system may be upgraded to a mod available in a fully regulated version that may provide safety features and allow a user to make a plurality of adjustments. Further, the disclosed system may include screens and adjustment buttons which the user may use to choose from all sorts of settings (such as power level, temperature, coil material, and even set a pattern for the power output using custom curve modes). Further, the disclosed system may keep the output stable at a level chosen by the user. Further, the disclosed system may include a circuit board and an internal chip to adjust the output as required. Further, in an instance when the battery/batteries are fully charged, it is a known problem in the art that the output may be higher; the MOSFET chip may configured to moderate the output to maintain desired levels of electrical current. It is further a known problem in the art that when a battery is nearly drained, the level of electrical current may be insufficient to enable full function of the mod. When the battery level is low, the MOSFET chip may be configured to prevent the mod from activating as it cannot meet the required power level. Further, the disclosed system may drop the output to what the battery may allow and warn the user on the screen. In addition to varying the wattage or voltage output, the user may set a temperature to heat the coil. This may prevent burning.

Further, the disclosed system may include pure PWM (Pulse Width Regulation) mods that are digital versions of power regulation. Further, the disclosed system may be custom-made for the user. Further, the disclosed system may be configured to switch the power on and off quickly to provide an average power. Further, the disclosed system may prevent overstressing of the batteries and malfunctions in the board or chip.

The vaporizer system may include a PCB portion of the system. Further, the PCR portion may include a MOSFET chip, wiring, and connecting point for a removable atomizer.

Further, in some embodiments, the disclosed system may include a fire switch communicatively coupled to the MOSFET chip that may be electrically coupled with a rechargeable power source. Further, the MOSFET chip may be communicatively coupled to a coil using pins (such as a negative pin and a positive pin) and connectors. Further, the coil may be comprised inside the atomizer.

DETAILED DESCRIPTION

Figure 1:
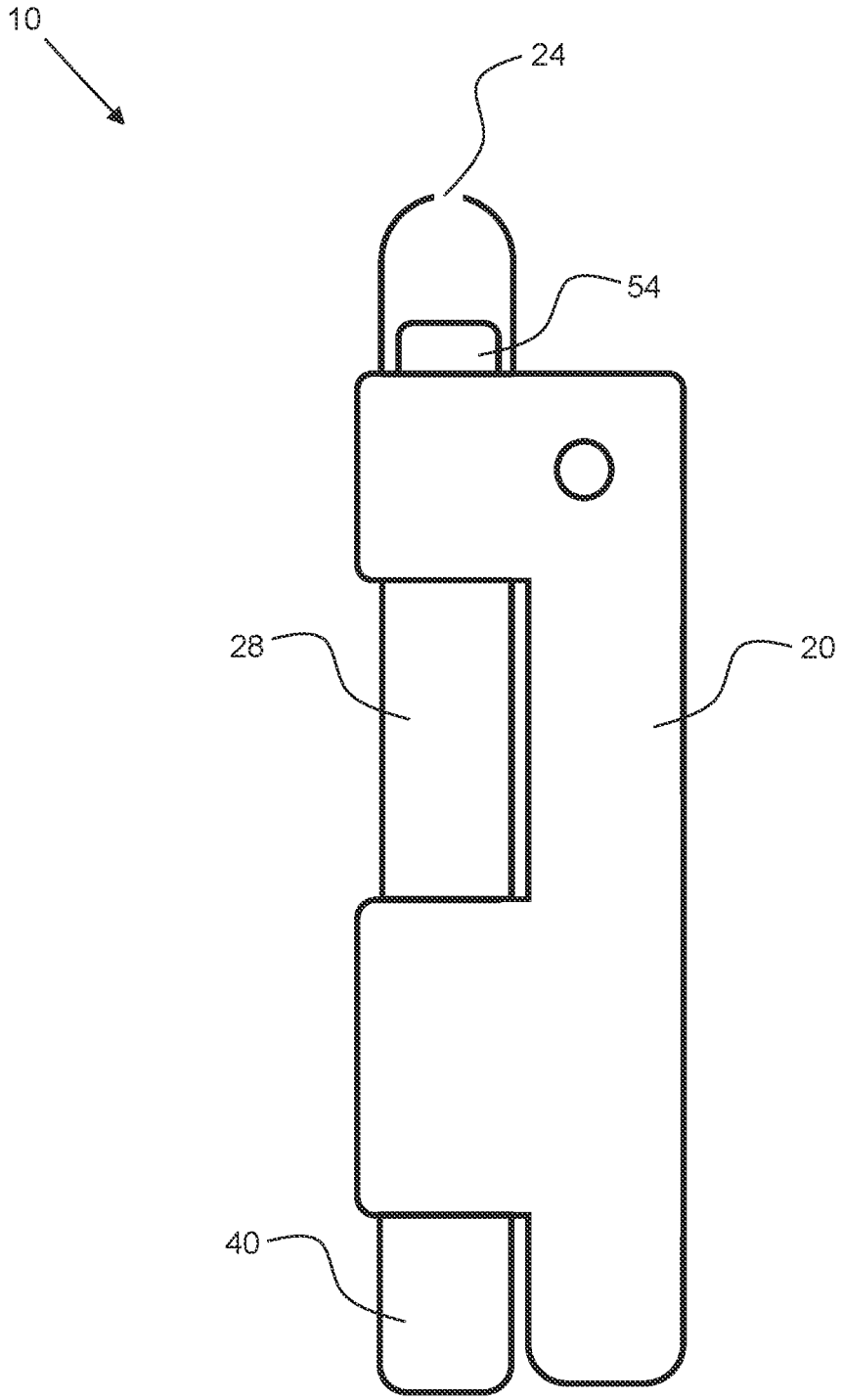
FIG. 1 is a front view of a vaporizer system.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

The present disclosure includes many aspects and features. Moreover, while many aspects and features relate to, and are described in the context of a vaporizer system, embodiments of the present disclosure are not limited to use only in this context.

The directional terms "distal" and "proximal" are used throughout this description and the preceding summary. The term "proximal" is used herein to describe a direction "towards" a user of the invention while the invention is being used to inhale vapor, in which the orifice is in preferred embodiments most proximal to the user. The term "distal" is used herein to describe a direction "away from" a user of the invention while the invention is being used by the user to inhale vapor. These terms may also be used to describe locations of the components of the invention relative to one another. For example, an exemplary Component A may be proximal to a Component B, meaning that Component A is closer to the user of the invention while the invention is being used by the user to inhale vapor.

As shown in FIG. 1, a vaporizer system 10 has a dispenser receptacle 28 configured within a housing 20. An atomizer 54 is also configured within the housing 20. An orifice 24 is configured at the most proximal end of the housing 20. An advancement mechanism 40 is configured at the most distal end of the housing 20.

Figure 2:
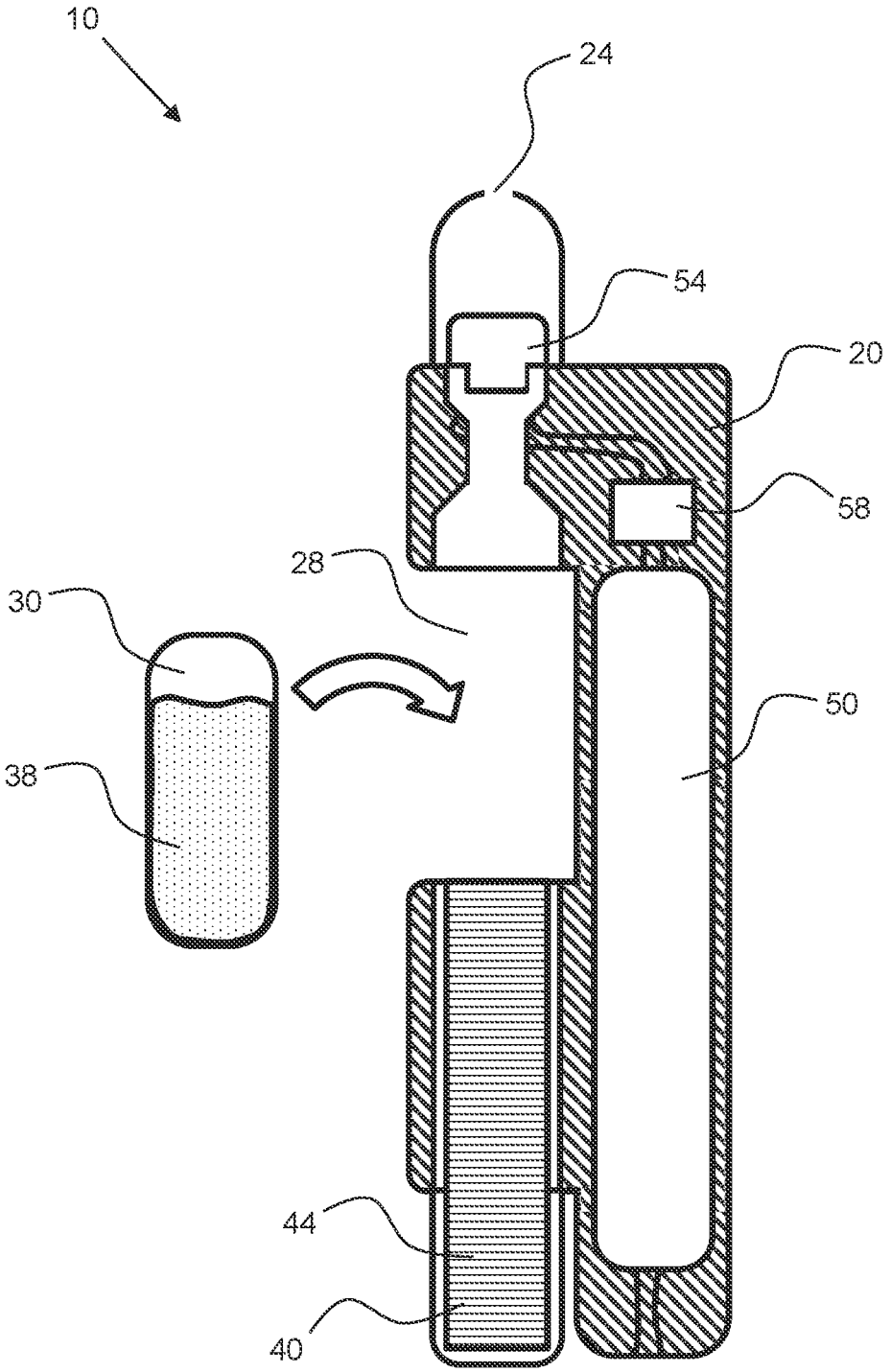
FIG. 2 is a front cross-sectional view of the vaporizer system of FIG. 1.

As shown in FIG. 2, a dispenser 30 is removably configured within the dispenser receptacle 28. A vaporizable substance 38 is configured within the dispenser 30. The movement mechanism 40 includes a screw 44, which may be rotated to advance at least some of the vaporizable substance 38 from the dispenser 30 into the atomizer 54 to be vaporized. The vapor created by vaporizing the vaporizable substance 38 may travel out of the orifice 24 to be inhaled by a user.

A battery 50 is electrically coupled to a MOSFET 58. The MOSFET 58 is electrically coupled to the atomizer 54. The battery 50 may supply power to the atomizer 54 whereby the atomizer 54 supplies heat to the vaporizable substance 38, thereby vaporizing the vaporizable substance 38. The MOSFET 58 may regulate the amount of power that is delivered from the battery 50 to the atomizer 54.

Figure 3:
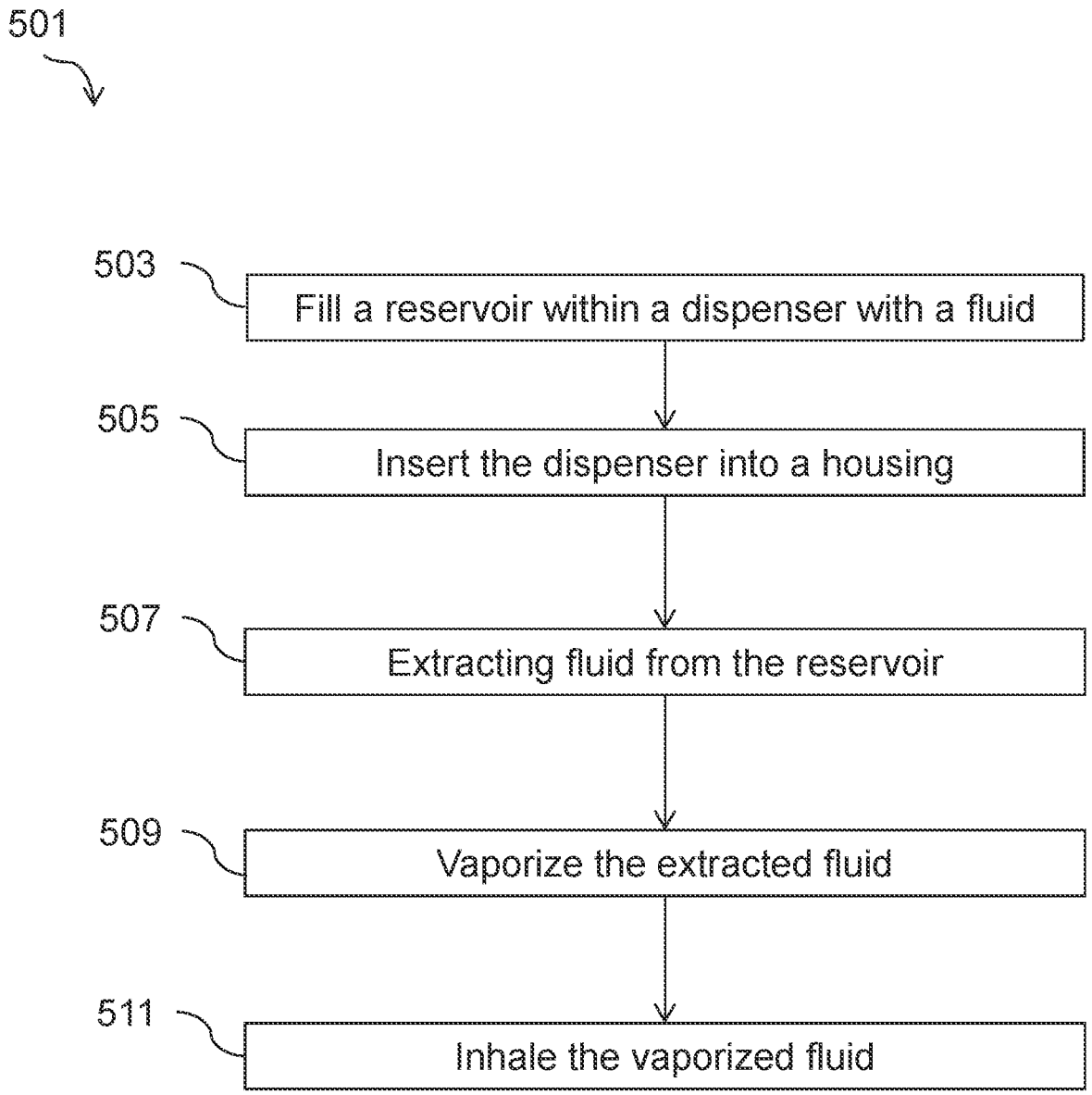
FIG. 3 is a flowchart of a method of creating a vapor to be inhaled, in accordance with some embodiments of the present invention.

In FIG. 3, a method 501 of creating a vapor to be inhaled, in accordance with some embodiments is depicted. Accordingly, at 503, the method 501 includes filling a reservoir within a dispenser with a fluid. Further, at 505, the method 501 may include inserting the dispenser into a housing. Further, at 507, the method 501 may include extracting fluid from the reservoir. Further, at 509, the method 501 may include vaporizing the extracted fluid. Further, at 511, the method 501 may include inhaling the vaporized fluid.

Figure 4:
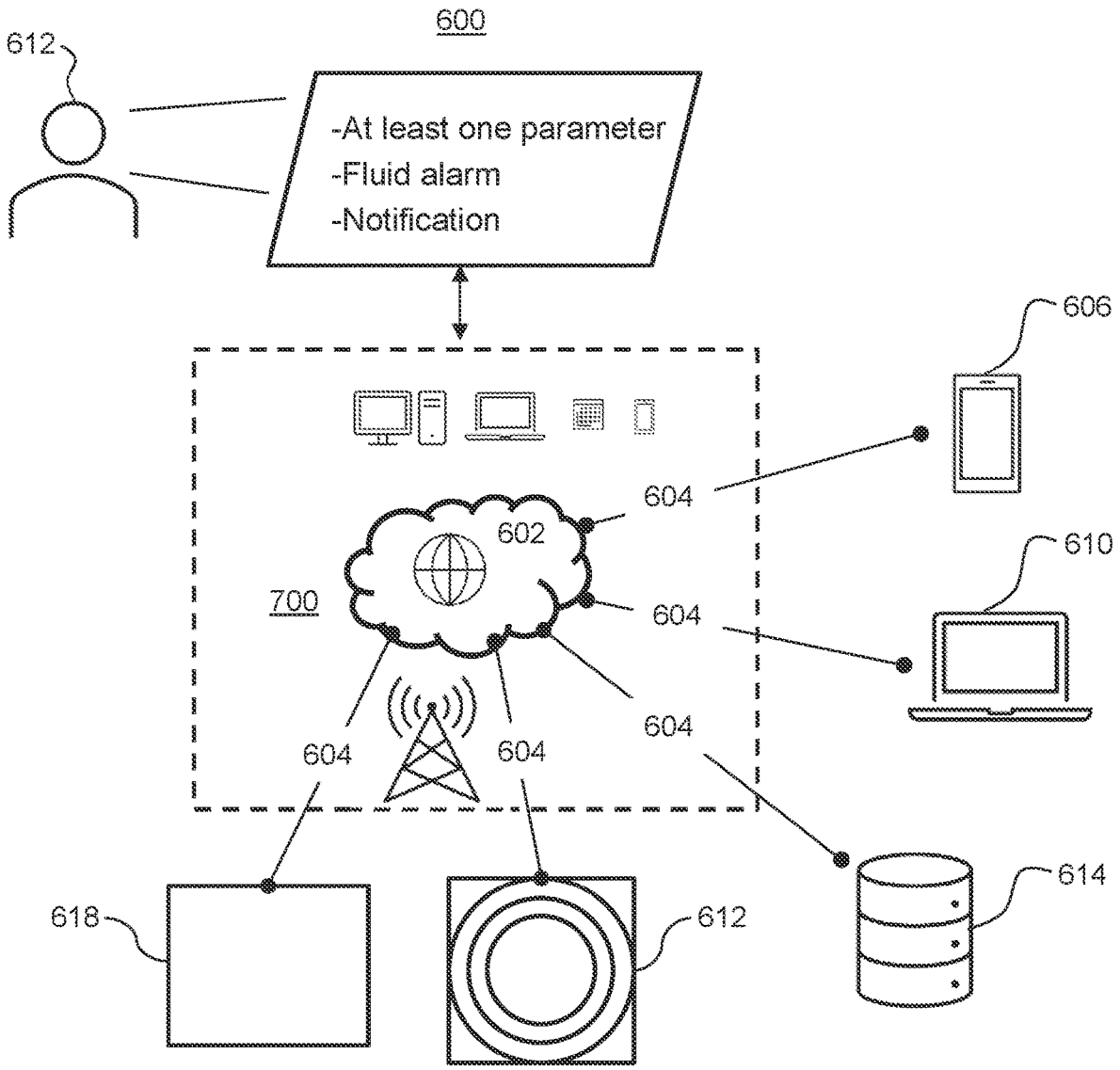
FIG. 4 is a diagram of an online platform consistent with various embodiments of the present invention.

In FIG. 4, an online platform 600 is depicted and is consistent with various embodiments of the present disclosure. By way of non-limiting example, the online platform 600 to vaporize a fluid using the vaporizer system may be hosted on a centralized server 602, such as, for example, a cloud computing service. The centralized server 602 may communicate with other network entities, such as, for example, a mobile device 606 (such as a smartphone, a laptop, a tablet computer, etc.), other electronic devices 610 (such as desktop computers, server computers, etc.), databases 614, sensors, actuators (not shown) and an apparatus 618 (such as the vaporizer system) over a communication network 604, such as, but not limited to, the Internet. Further, users of the online platform 600 may include relevant parties such as, but not limited to, end-users, service providers, service receivers, and administrators. Accordingly, in some instances, electronic devices operated by the one or more relevant parties may be in communication with the online platform 600.

A user 612, such as the one or more relevant parties, may access the online platform 600 through a web-based software application or browser. The web-based software application may be embodied as, for example, but not be limited to, a website, a web application, a desktop application, and a mobile application compatible with a computing device 700.

Figure 5:
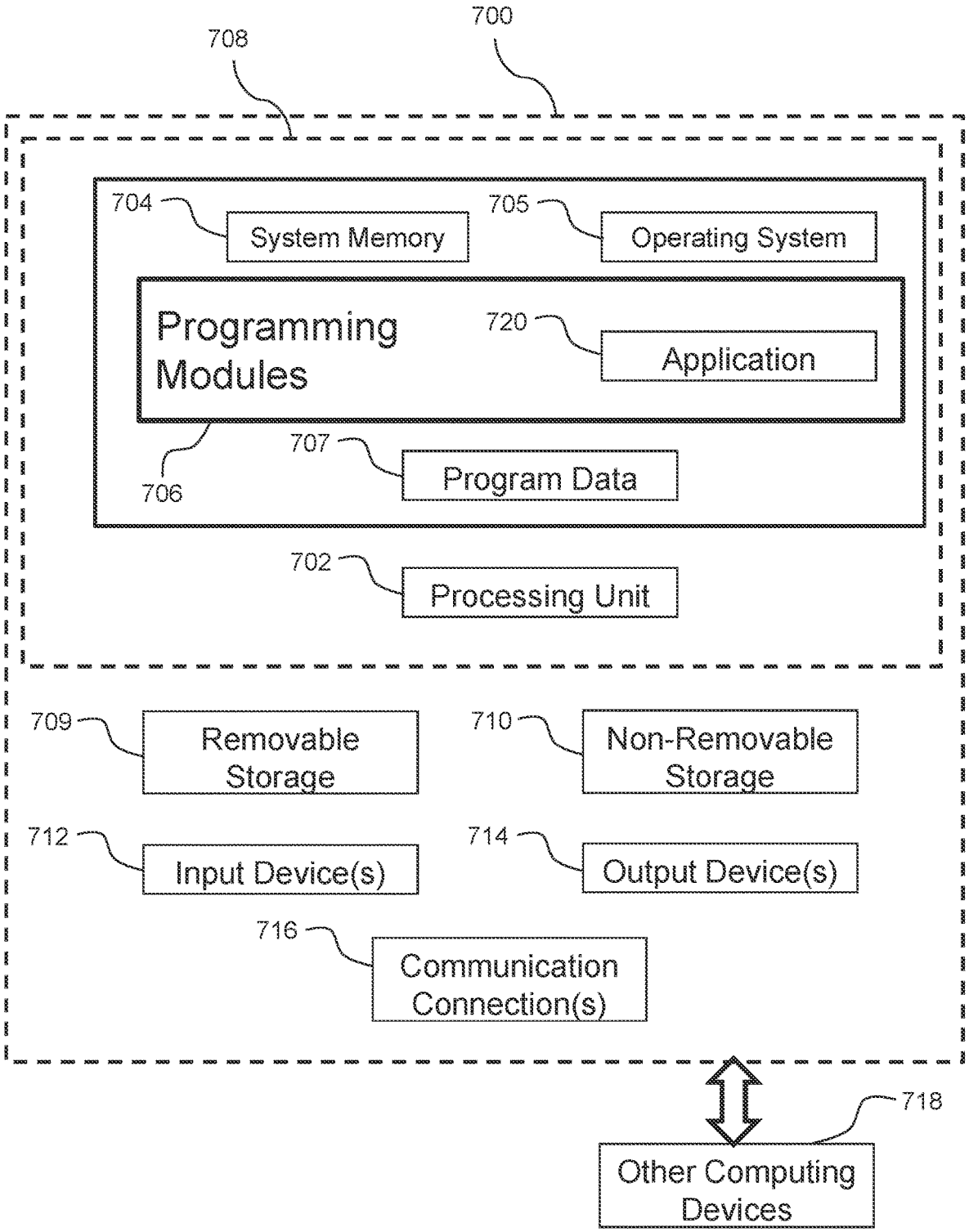
FIG. 5 is a block diagram of a computing device for implementing the methods disclosed herein, in accordance with some embodiments of the present invention.

As shown in FIG. 5, a system consistent with an embodiment of the disclosure may include a computing device or cloud service, such as computing device 700. In a basic configuration, computing device 700 may include at least one processing unit 702 and a system memory 704. Depending on the configuration and type of computing device, system memory 704 may comprise, but is not limited to, volatile (e.g., random-access memory (RAM)), nonvolatile (e.g., read-only memory (ROM)), flash memory, or any combination. System memory 704 may include operating system 705, one or more programming modules 706, and may include a program data 707. Operating system 705, for example, may be suitable for controlling computing device 700's operation. In one embodiment, programming modules 706 may include image-processing module, machine learning module and/or image classifying module. Furthermore, embodiments of the disclosure may be practiced in conjunction with a graphics library, other operating systems, or any other application program and is not limited to any particular application or system. This basic configuration is illustrated in FIG. 5 by those components within a dashed line 708.

Figure 6:
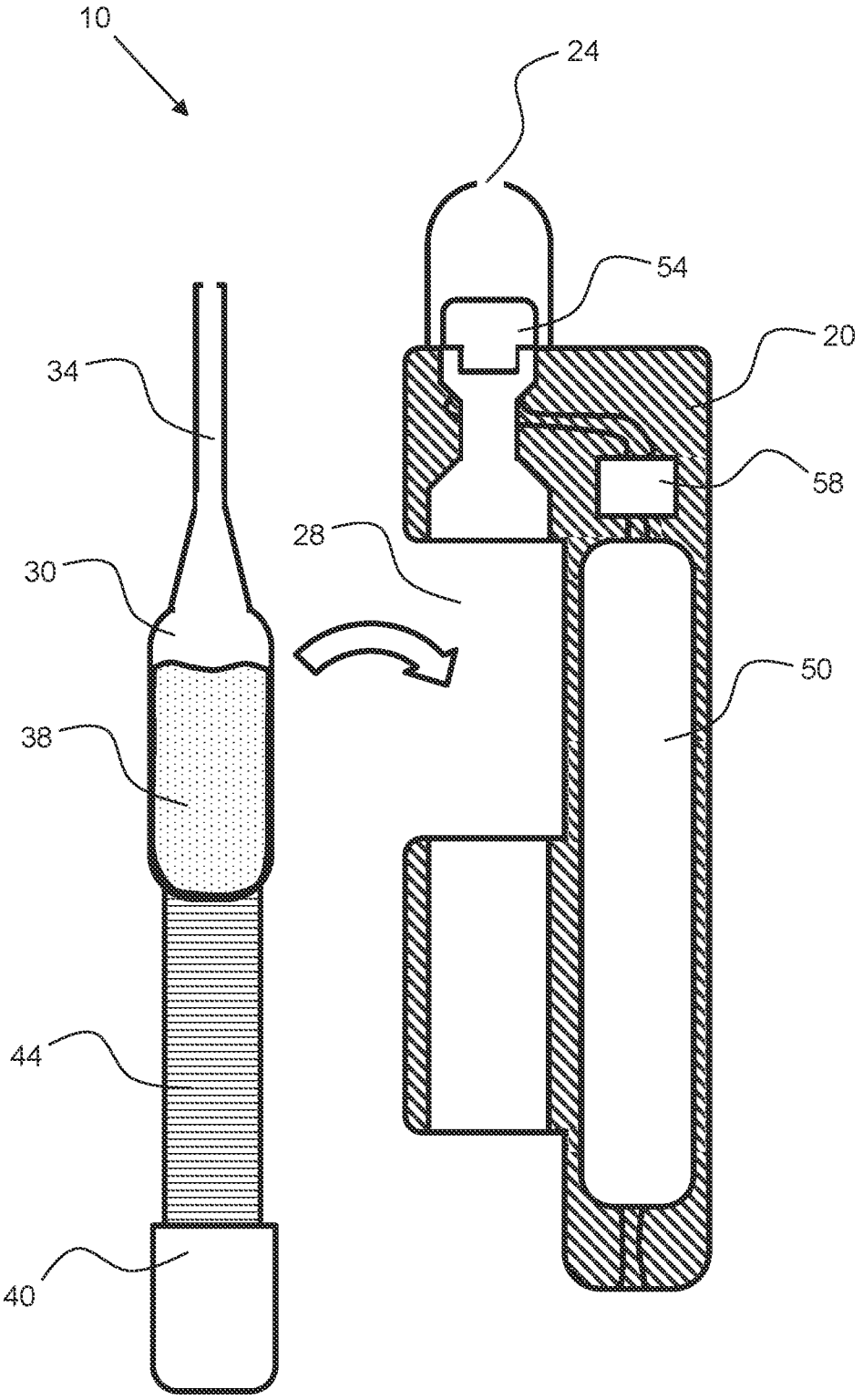
FIG. 6 is a front cross-section view of a vaporizer system with an advancement mechanism connected to a dispenser.
Figure 7:
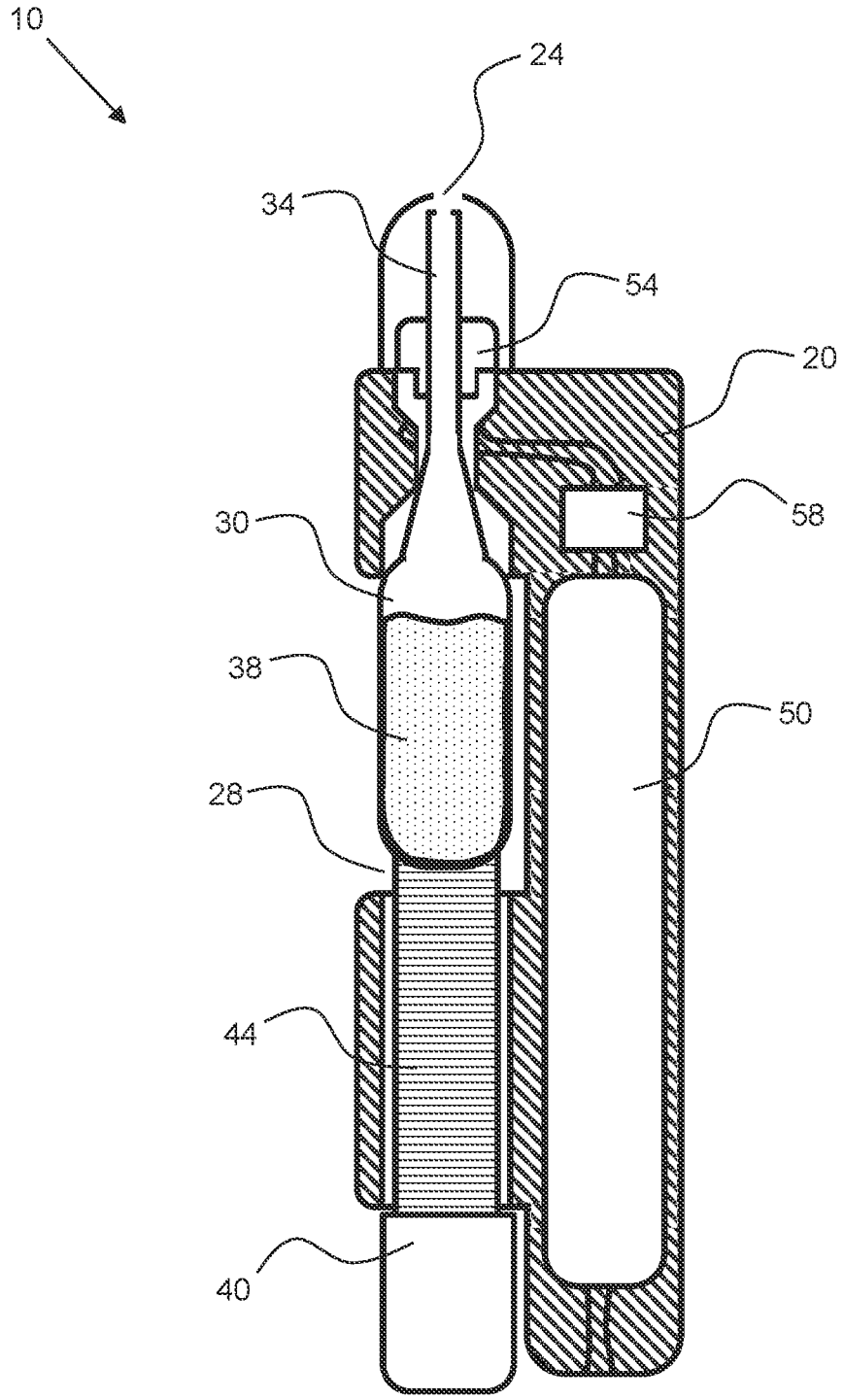
FIG. 7 is a front cross-section view of a vaporizer system of FIG. 6 with both the advancement mechanism and dispenser configured within a housing.

As shown in FIGS. 6 and 7, the dispenser 30 and advancement mechanism 40 are both removably configured within the housing 20. The advancement mechanism 40 shown in FIGS. 6 and 7 includes a screw 44 that may be rotated to advance at least some of the vaporizable substance 38 from the dispenser 30 into the atomizer 54 to be vaporized. The screw 44 may be permanently or removably connected to the dispenser 30. In such embodiments, the dispenser 30 may comprise threads that engage with the threads of the screw 44, whereby when the screw rotates, the screw 44 advances proximally through the dispenser 30.

Also as shown in FIGS. 6 and 7, a dispensing tip 34 is connected to the dispenser 30. When vaporizable substance 38 is advanced from the dispenser 30 into the atomizer 54, the vaporizable substance 38 may be advanced through the dispensing tip 34. At least a portion of the dispensing tip 34 may be configured within the atomizer 54 whereby vaporizable substance 38 configured in the atomizer 54 is also configured within the dispensing tip 34. The dispensing tip 34 may be configured distal to the orifice 24. Vapor created from the vaporizable substance 38 may travel proximally through the dispensing tip 34 and exit the housing 20 via the orifice 24.

The dispensing tip 34 may be permanently connected to the dispenser 30. In some embodiments, the dispenser 30 and dispensing tip 34 may be formed as a monolithic piece. In other embodiments, the dispenser 30 and dispensing tip 34 may be formed as separate pieces and then joined together by means such as but not limited to press fit or adhesive(s).

The computing device 700 may have additional features or functionality. For example, computing device 700 may also further comprise additional data storage devices, whether removable and/or non-removable, such as, for example, magnetic disks, optical disks, magnetic tape, and other storage media known in the art as computer storage media. An example of such data storage devices is illustrated in FIG. 5 by a removable storage 709 and a non-removable storage 710. Computer storage media may include volatile and nonvolatile, removable and non-removable media implemented in any method or technology for storage of information, such as computer-readable instructions, data structures, program modules, or other data. System memory 704, removable storage 709, and non-removable storage 710 are all computer storage media examples (i.e., memory storage.) Computer storage media may include, but is not limited to, RAM, ROM, electrically erasable read-only memory (EEPROM), flash memory or other memory technology, CD-ROM, digital versatile disks (DVD) or other optical storage, magnetic cassettes, magnetic tape, magnetic disk storage or other magnetic storage devices, or any other medium which can be used to store information and which can be accessed by computing device 700. Any such computer storage media may be part of device 700. Computing device 700 may also have input device(s) 712 such as a keyboard, a mouse, a pen, a sound input device, a touch input device, a location sensor, a camera, a biometric sensor, etc. Output device(s) 714 such as a display, speakers, a printer, etc. may also be included. The aforementioned devices are examples and others may be used.

The computing device 700 may also contain a communication connection 716 that may allow device 700 to communicate with other computing devices 718, such as over a network in a distributed computing environment, for example, an intranet or the Internet. Communication connection 716 is one example of communication media. Communication media may typically be embodied by computer-readable instructions, data structures, program modules, or other data in a modulated data signal, such as a carrier wave or other transport mechanism, and includes any information delivery media. The term "modulated data signal" may describe a signal that has one or more characteristics set or changed in such a manner as to encode information in the signal. By way of example, and not limitation, communication media may include wired media such as a wired network or direct-wired connection, and wireless media such as acoustic, radio frequency (RF), infrared, and other wireless media. The term computer-readable media as used herein may include both storage media and communication media.

As stated above, a number of program modules and data files may be stored in system memory 704, including operating system 705. While executing on processing unit 702, programming modules 706 (e.g., application 720 such as a media player) may perform processes including, for example, one or more stages of methods, algorithms, systems, applications, servers, databases as described above. The aforementioned process is an example, and processing unit 702 may perform other processes. Other programming modules that may be used in accordance with embodiments of the present disclosure may include sound encoding/decoding applications, machine learning application, acoustic classifiers, etc.

Generally, consistent with embodiments of the disclosure, program modules may include routines, programs, components, data structures, and other types of structures that may perform particular tasks or that may implement particular abstract data types. Moreover, embodiments of the disclosure may be practiced with other computer system configurations, including hand-held devices, general-purpose graphics processor-based systems, multiprocessor systems, microprocessor-based or programmable consumer electronics, application-specific integrated circuit-based electronics, minicomputers, mainframe computers, and the like. Embodiments of the disclosure may also be practiced in distributed computing environments where tasks are performed by remote processing devices that are linked through a communications network. In a distributed computing environment, program modules may be located in both local and remote memory storage devices.

Furthermore, embodiments of the disclosure may be practiced in an electrical circuit comprising discrete electronic elements, packaged or integrated electronic chips containing logic gates, a circuit utilizing a microprocessor, or on a single chip containing electronic elements or microprocessors. Embodiments of the disclosure may also be practiced using other technologies capable of performing logical operations such as, for example, AND, OR, and NOT, including but not limited to mechanical, optical, fluidic, and quantum technologies. In addition, embodiments of the disclosure may be practiced within a general-purpose computer or in any other circuits or systems.

Embodiments of the disclosure, for example, may be implemented as a computer process (method), a computing system, or as an article of manufacture, such as a computer program product or computer-readable media. The computer program product may be a computer storage media readable by a computer system and encoding a computer program of instructions for executing a computer process. The computer program product may also be a propagated signal on a carrier readable by a computing system and encoding a computer program of instructions for executing a computer process. Accordingly, the present disclosure may be embodied in hardware and/or in software (including firmware, resident software, micro-code, etc.). In other words, embodiments of the present disclosure may take the form of a computer program product on a computer-usable or computer-readable storage medium having computer-usable or computer-readable program code embodied in the medium for use by or in connection with an instruction execution system. A computer-usable or computer-readable medium may be any medium that can contain, store, communicate, propagate, or transport the program for use by or in connection with the instruction execution system, apparatus, or device.

The computer-usable or computer-readable medium may be, for example but not limited to, an electronic, magnetic, optical, electromagnetic, infrared, or semiconductor system, apparatus, device, or propagation medium. More specific computer-readable medium examples (a non-exhaustive list), the computer-readable medium may include the following: an electrical connection having one or more wires, a portable computer diskette, a random-access memory (RAM), a read-only memory (ROM), an erasable programmable read-only memory (EPROM or Flash memory), an optical fiber, and a portable compact disc read-only memory (CD-ROM). Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

Embodiments of the present disclosure, for example, are described above with reference to block diagrams and/or operational illustrations of methods, systems, and computer program products according to embodiments of the disclosure. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While certain embodiments of the disclosure have been described, other embodiments may exist. Furthermore, although embodiments of the present disclosure have been described as being associated with data stored in memory and other storage mediums, data can also be stored on or read from other types of computer-readable media, such as secondary storage devices, like hard disks, solid-state storage (e.g., USB drive), or a CD-ROM, a carrier wave from the Internet, or other forms of RAM or ROM. Further, the disclosed methods' stages may be modified in any manner, including by reordering stages and/or inserting or deleting stages, without departing from the disclosure.

Although the invention has been explained in relation to its preferred embodiment, it is to be understood that many other possible modifications and variations can be made without departing from the spirit and scope of the invention.

What is claimed is:

1. A vaporizer system comprising:

a housing;

a dispenser receptacle configured within the housing;

an orifice configured proximal to the dispenser receptacle;

an atomizer configured within the housing, the atomizer being configured distal to the orifice and proximal to the dispenser receptacle, a dispenser removably configured within the dispenser receptacle;

a dispensing tip formed as a monolithic piece with the dispenser whereby when the dispenser is removably configured within the dispenser receptacle, the dispensing tip extends through the atomizer, such that a proximal end of the dispensing tip is located proximal to a proximal end of the atomizer, and a distal end of the dispensing tip is located distal to a distal end of the atomizer;

vaporizable substance removably configured within the dispenser, such that when the dispenser is removably configured within the dispenser receptacle the portion of the dispenser that stores the vaporizable substance is separated from the atomizer;

an advancement mechanism configured distal to the dispenser; and a battery removably configured within the housing and configured to power the atomizer, wherein the advancement mechanism advances at least some of the vaporizable substance from the dispenser through the dispensing tip whereby the at least some of the vaporizable substance passes through the atomizer, wherein the atomizer applies heat to the at least some of the vaporizable substance, whereby the at least some of the vaporizable substance is vaporized, wherein the at least some of the vaporizable substance that is vaporized exits the housing via the orifice.

2. The vaporizer system of claim 1, wherein the atomizer is not removable from the housing.

3. The vaporizer system of claim 1, wherein the vaporizable substance is a cannabis extract.

4. The vaporizer system of claim 1, wherein the vaporizable substance is a tobacco extract.

5. The vaporizer system of claim 1, wherein the vaporizable substance is a liquid before it is vaporized.

6. The vaporizer system of claim 1, wherein the advancement mechanism comprises:

a screw comprising screw threads; and a motor, wherein the screw threads of the screw engage with corresponding housing threads of the housing, wherein the motor is powered by the battery, wherein the motor rotates the screw, whereby the screw is advanced proximally through the housing, whereby the screw advances the at least some of the vaporizable substance from the dispenser into the atomizer.

7. The vaporizer system of claim 1, wherein the advancement mechanism comprises:

a piston; and a linear actuator, wherein the linear actuator is powered by the battery, wherein the linear actuator advances the piston proximally through the housing, whereby the piston advances the at least some of the vaporizable substance from the dispenser into the atomizer.

8. The vaporizer system of claim 1, wherein the advancement mechanism comprises:

a pump, wherein the pump is powered by the battery, wherein the pump uses pressure to advance the at least some of the vaporizable substance from the dispenser into the atomizer.

9. The vaporizer system of claim 1, wherein the atomizer uses one or more coils to apply heat to the vaporizable substance.

10. The vaporizer system of claim 1, further comprising:

a processing device;

a communication device;

a storage device;

at least one sensor; and a user device, wherein the processing device is communicatively coupled with the communication device and the storage device, wherein the at least one sensor obtains sensor data, wherein the storage device stores the sensor data, wherein the processing device analyzes the sensor data, wherein the communication device transmits the sensor data to the user device, wherein the processing device detects if any of the sensor data exceeds a sensor data threshold, whereby the communication device transmits an alarm to the user device.

11. The vaporizer system of claim 10, wherein the sensor data are measurements of an amount of vaporizable substance configured within the dispenser.

12. The vaporizer system of claim 10, wherein the sensor data are measurements of a volume of vapor created by the vaporizer system.

13. The vaporizer system of claim 10, wherein the sensor data are measurements of a pressure of vapor created by the vaporizer system, wherein the vapor having the pressure is configured within the housing of the vaporizer system.

14. The vaporizer system of claim 10, wherein the sensor data are durations of time for which the battery will continue to provide power.

15. The vaporizer system of claim 1, further comprising:

a MOSFET chip, wherein the MOSFET chip controls an amount of power provided by the battery.

16. The vaporizer system of claim 15, wherein the MOSFET chip controls the amount of power provided by the battery by means of pulse width modulation.

17. The vaporizer system of claim 15, wherein the MOSFET chip prevents a short circuit from occurring within the vaporizer system.

18. The vaporizer system of claim 15, wherein the MOSFET chip controls an amount of power supplied by the battery, and wherein the MOSFET chip controls an amount of power supplied by the battery to the advancement mechanism, wherein the amount of power supplied by the battery to the atomizer and the amount of power supplied by the battery to the advancement mechanism are controlled independently of one another by the MOSFET chip.

19. The vaporizer system of claim 15 further comprising an input device, wherein the MOSFET chip is configured to adjust the amount of power provided by the battery according to input by the user.

20. The vaporizer system of claim 19, wherein the user adjusts the amount of power provided by the battery to regulate the heat provided by the atomizer to the vaporizable substance, whereby the vaporizable substance is vaporized and not burned.

* * * * *